US011443711B2

(12) United States Patent
Gao

(10) Patent No.: US 11,443,711 B2
(45) Date of Patent: Sep. 13, 2022

(54) LIQUID CRYSTAL DISPLAY PANEL IMPROVING FLICKER PROBLEM DUE TO DIFFERENCE OF GREY VOLTAGES AND REFRESHING FREQUENCY

(71) Applicant: TCL China Star Optoelectronics Technology Co., Ltd., Shenzhen (CN)

(72) Inventor: Xiang Gao, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 129 days.

(21) Appl. No.: 16/759,356

(22) PCT Filed: Apr. 15, 2020

(86) PCT No.: PCT/CN2020/084844

§ 371 (c)(1),
(2) Date: Apr. 27, 2020

(87) PCT Pub. No.: WO2021/196289

PCT Pub. Date: Oct. 7, 2021

(65) Prior Publication Data

US 2022/0044650 A1 Feb. 10, 2022

(30) Foreign Application Priority Data

Apr. 1, 2020 (CN) ..... 202010251173.6

(51) Int. Cl.
*G09G 3/36* (2006.01)

(52) U.S. Cl.
CPC ..... *G09G 3/3688* (2013.01); *G09G 3/3607* (2013.01); *G09G 2300/0842* (2013.01); *G09G 2310/027* (2013.01); *G09G 2310/08* (2013.01)

(58) Field of Classification Search
CPC ..... G09G 3/36; G09G 3/3607; G09G 3/3611; G09G 3/3618; G09G 3/3622; G09G 3/3625; G09G 3/3674; G09G 3/3677; G09G 3/3681; G09G 3/3685; G09G 3/3688; G09G 3/3692; G09G 2310/08
USPC ..... 345/87–104
See application file for complete search history.

(56) References Cited

U.S. PATENT DOCUMENTS 10,147,370 B2 12/2018 Verbeure et al.
2006/0267893 A1* 11/2006 Kim ..... G09G 3/3611 345/89
2009/0015531 A1* 1/2009 Tsai ..... G09G 3/3611 345/89

(Continued)

FOREIGN PATENT DOCUMENTS

CN 107358933 11/2017
CN 108335677 7/2018

(Continued)

*Primary Examiner* — Alexander Eisen
*Assistant Examiner* — Nelson Lam

(57) ABSTRACT

A timing controller includes a detecting circuit, a control circuit, and a compensation circuit. The timing controller reads the compensation values according to the variance between refreshing frequencies and compensate the second basic value in the white balance data driving table based on the first basic value accordingly. This could efficiently improve the grey voltage difference between after and before switching the refreshing frequency. This could efficiently improve the flicker issue.

18 Claims, 2 Drawing Sheets

(56) References Cited

U.S. PATENT DOCUMENTS

| | | | | |
|---|---|---|---|---|
| 2010/0007595 | A1* | 1/2010 | Chiang | G09G 3/3648 345/98 |
| 2013/0187960 | A1* | 7/2013 | Lee | G09G 3/3648 345/691 |
| 2014/0002465 | A1* | 1/2014 | Kwa | G09G 5/395 345/522 |
| 2014/0267785 | A1* | 9/2014 | Chen | G09G 5/02 348/189 |
| 2015/0145900 | A1* | 5/2015 | Lee | G09G 3/36 345/691 |
| 2015/0194111 | A1* | 7/2015 | Slavenburg | G09G 3/3614 345/209 |
| 2015/0255028 | A1* | 9/2015 | Suyama | G09G 3/3618 345/98 |
| 2015/0348509 | A1* | 12/2015 | Verbeure | G06T 1/20 345/213 |
| 2017/0124934 | A1* | 5/2017 | Verbeure | G09G 3/3611 |
| 2018/0040286 | A1* | 2/2018 | Huang | F16H 19/06 |

FOREIGN PATENT DOCUMENTS

| | | | | |
|---|---|---|---|---|
| CN | 110751933 | | | 2/2020 |
| CN | 107945756 | B | * | 4/2020 |
| CN | 111770322 | A | * | 10/2020 |
| CN | 111312191 | B | * | 4/2021 |
| CN | 111641820 | B | * | 8/2021 |

* cited by examiner

LIQUID CRYSTAL DISPLAY PANEL IMPROVING FLICKER PROBLEM DUE TO DIFFERENCE OF GREY VOLTAGES AND REFRESHING FREQUENCY

RELATED APPLICATIONS

This application is a National Phase of PCT Patent Application No. PCT/CN2020/084844 having International filing date of Apr. 15, 2020, which claims the benefit of priority of Chinese Patent Application No. 202010251173.6 filed on Apr. 1, 2020. The contents of the above applications are all incorporated by reference as if fully set forth herein in their entirety.

FIELD AND BACKGROUND OF THE INVENTION

The present invention relates to an LCD panel technique field, and more particularly, to a timing controller technical field, a timing controller and display panel.

FreeSync (adaptive synchronization technology) display allows the graphic card and the acceleration processor could directly and dynamically control the refreshing frequency of the display. The refreshing frequency of the FreeSync display could be adjusted to be automatically consistent with the frame rate of a game. This could prevent the display from displaying the screen tearing phenomenon.

However, an incorrect value in the white balance data driving table may be obtained at the time of switching the refreshing frequency due to the delay of detection response and LC response. This leads to incorrect grey voltages and a huge luminance difference between before and after the switching operation. Thus, the screen may have flickers.

SUMMARY OF THE INVENTION

One objective of an embodiment of the present invention is to provide a timing controller, in order to solve the above-mentioned issue of obtaining incorrect value in the white balance data driving table may be obtained at the time of switching the refreshing frequency. Thus, the flicker issue could be solved.

According to an embodiment of the present invention, a timing controller is disclosed. The timing controller has a white balance data driving table. The timing controller comprises: a detecting circuit, configured to detect and obtain a refreshing frequency according to a frame starting signal of the timing controller; a control circuit, connected to an output end of the detecting circuit, configured to receive the refreshing frequency, buffer a first refreshing frequency corresponding to a previous frame, and output a control command corresponding to a variance between the first refreshing frequency and a second refreshing frequency corresponding to a current frame; and a compensation circuit having a compensation data table, connected to an output end of the control circuit, configured to read a compensation value corresponding to the variance stored in the compensation data table and a first basic value corresponding to the first refreshing frequency stored in the white balance data driving table to compensate a second basic value corresponding to the second refreshing frequency stored in the white balance data driving table according to the control command; wherein when the variance is zero, the control circuit stop outputting the control command; and when the variance is not zero, the second basic value is a sum of the first basic value and the compensation value.

According to an embodiment of the present invention, the variance is a difference between the second refreshing frequency and the first refreshing frequency; a scale of the variance is corresponding to a scale of the compensation value; when the variance is more than zero, the compensation value is a negative value; and when the variance is less than zero, the compensation value is a positive value.

According to an embodiment of the present invention, the variance is a difference between the second refreshing frequency and the first refreshing frequency; a scale of the variance is corresponding to a scale of the compensation value; when the variance is more than zero, the compensation value is a positive value; and when the variance is less than zero, the compensation value is a negative value.

According to an embodiment of the present invention, when the variance is not zero, the compensation circuit writes a sum of the first basic value and the compensation value into an address corresponding to the second basic value in the write balance data driving table.

According to an embodiment of the present invention, the timing controller further comprises a white balance processing unit storing the white balance data driving table.

According to an embodiment of the present invention, the control circuit comprises a random access memory, configured to buffering the first refreshing frequency.

According to an embodiment of the present invention, the compensation circuit comprises a register, configured to store the compensation data table.

According to an embodiment of the present invention, the white balance data driving table comprises a plurality of basic values, configured to adjust a corresponding grey voltage; and the first basic value and the second basic value are both the basic values.

According to an embodiment of the present invention, a method for adjusting a grey voltage of a liquid crystal display (LCD) panel is disclosed. The method comprises: obtaining a refreshing frequency of a frame of the LCD panel; calculating a variance between a second refreshing frequency corresponding to a current frame and a first refreshing frequency corresponding to a previous frame; and reading a compensation value corresponding to the variance stored in the compensation data table and a first basic value corresponding to the first refreshing frequency stored in the white balance data driving table to compensate a second basic value corresponding to the second refreshing frequency stored in the white balance data driving table according to the variance; wherein when the variance is not zero, the second basic value is a sum of the first basic value and the compensation value; and the first basic value and the second basic value are both configured to adjust a corresponding grey voltage.

According to an embodiment of the present invention, an LCD panel is disclosed. The LCD panel comprises the above-mentioned timing controller.

An embodiment of the present invention provides a timing controller. The timing controller could obtain a compensation value according to the variance of the refreshing frequency and compensate the second basic value in the white balance data driving table based on the first basic value. This could efficiently improve the flicker problem due to the huge difference of grey voltages between before and after switching the refreshing frequency.

DESCRIPTION OF SPECIFIC EMBODIMENTS OF THE INVENTION

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
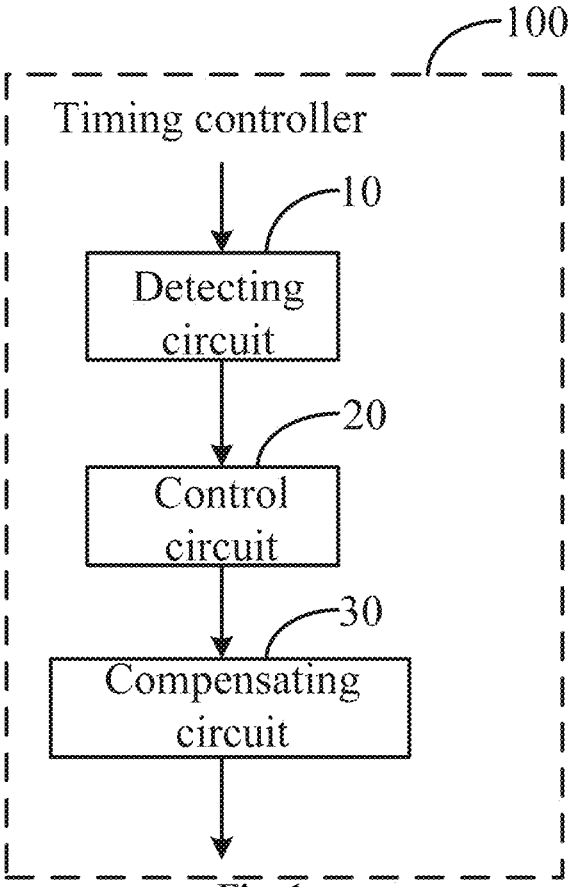
FIG. 1 is a diagram of a timing controller according to an embodiment of the present invention.
Figure 2:
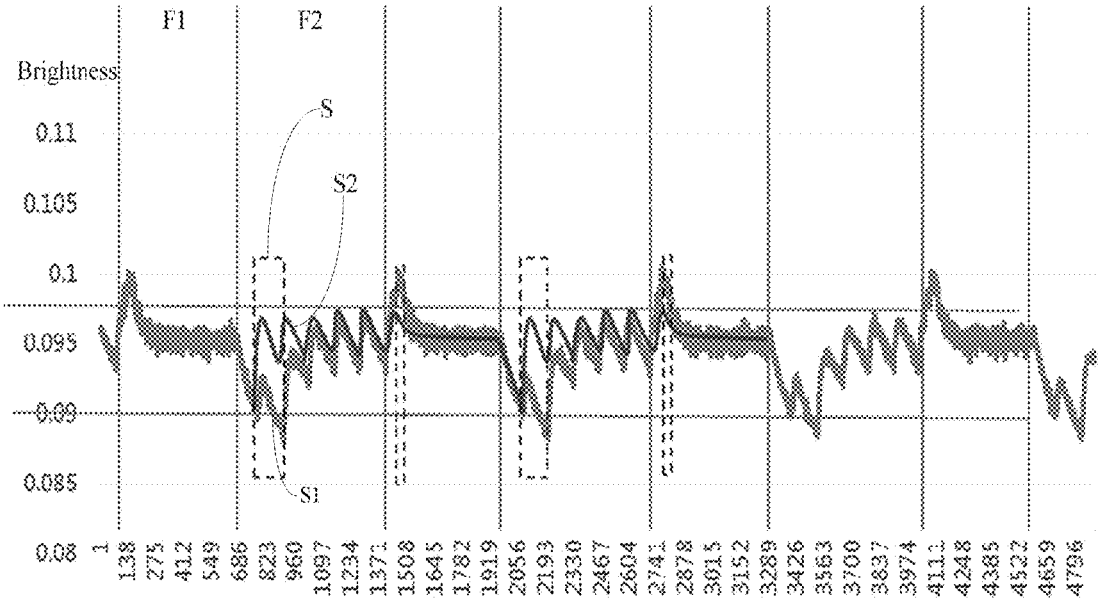
FIG. 2 is a diagram showing the luminance effect of the timing controller shown in FIG. 1 before and after the compensation.

Please refer to FIG. 1 and FIG. 2. An embodiment of the present invention provides a timing controller 100. The timing controller 100 has a white balance data driving table. The timing controller 100 comprises a detection unit 10, a control circuit 20 and a compensation circuit 30. The detecting circuit 10 detects and obtains a refreshing frequency of each frame according to a frame starting signal of the timing controller 100 and could efficiently raises the efficiency of detecting the refreshing frequency. The control circuit 20 receives the refreshing frequency of each frame from the detecting circuit 10, buffers the first refreshing frequency F1 corresponding to a previous frame, calculates the variance between the first refreshing frequency F1 and a second refreshing frequency F2 corresponding to a current frame, and outputs a control command corresponding to the variance. Here, when the variance is zero, the control circuit 20 stop outputting the control command. When the variance is not zero, the compensation circuit 30 reads a compensation value corresponding to the variance stored in the compensation data table and a first basic value corresponding to the first refreshing frequency F1 stored in the white balance data driving table, adds the first basic value and the compensation value up and uses the adding result as a second basic value, and writes an adding result into an address corresponding to the second basic value in the write balance data driving table to compensate the second basic value corresponding to the second refreshing frequency F2 in the white balance data driving table.

The basic values in the white balance data driving table could be used to adjust corresponding grey voltages to control the rotation of liquid crystals (LC) such that corresponding luminance adjustment could be achieved. This reduces the luminance difference between before and after switching the refreshing frequency could be reduced and improves the flicker problems.

In another embodiment, the variance could be, but not limited to, the difference between the second refreshing frequency F2 and the first refreshing frequency F1. That is, the variance is the value of the second refreshing frequency F2 subtracting the first refreshing frequency F1. The scale of the variance is corresponding to the scale of the compensation value. When the variance is more than zero, the compensation value is a negative value. When the variance is less than zero, the compensation value is a positive value.

As shown in FIG. 2, for example, the second refreshing frequency F2 is 48 Hz and the first refreshing frequency F1 is 240 Hz. The variance is −192 Hz. The grey voltage determined by the first basic value corresponding to the first refreshing frequency F1 could be represented as 225 in decimal. The grey voltage determined by the compensation value corresponding to the variance could be represented by 86 in decimal. Furthermore, the grey voltage determined by the second basic value corresponding to the second refreshing frequency F2 is 226−86=139. When the second refreshing frequency F2 is 120 Hz, the variance is −120 Hz. The grey voltage determined by the compensation value corresponding to the variance is 68 and the grey voltage determined by the second basic value is 225−68=157. From the above, this embodiment could read the corresponding compensation value based on the variance of refreshing frequencies and determine the second basic value according to the sum of the first basic value and the compensation value. This improves the grey voltage of the key region S after switching the refreshing frequency and could efficiently compensate the luminance curve S1 into the compensated luminance curve S2. This improves the luminance difference and solves the flicker issue.

The variance could be the difference between the first refreshing frequency F1 and the second refreshing frequency F2. That is, the variance is the value of the first refreshing frequency F1 subtracting the second refreshing frequency F2. The scale of the variance is corresponding to the scale of the compensation value. Similarly, when the variance is more than zero, the compensation value is a positive value. When the variance is less than zero, the compensation value is a negative value.

The scale of the compensation value could be determined according to the demands of uniformity to achieve different requirements.

When the variance is not zero, the compensation 30 calculates the adding result of the first basic value and the compensation value and writes the adding result into the address corresponding to the second basic value in the white balance data driving table.

The timing controller 100 further comprises a white balance processing unit. The white balance data driving table is set in the white balance processing unit.

The control circuit 20 comprises a random access memory for buffering the first refreshing frequency F1.

The compensation circuit 30 comprises a register for storing the compensation data table.

The white balance data driving table comprises a plurality of basic values. The basic values are used to adjust corresponding grey voltages. Here, the first basic value and the second basic value are both basic values.

Figure 3:
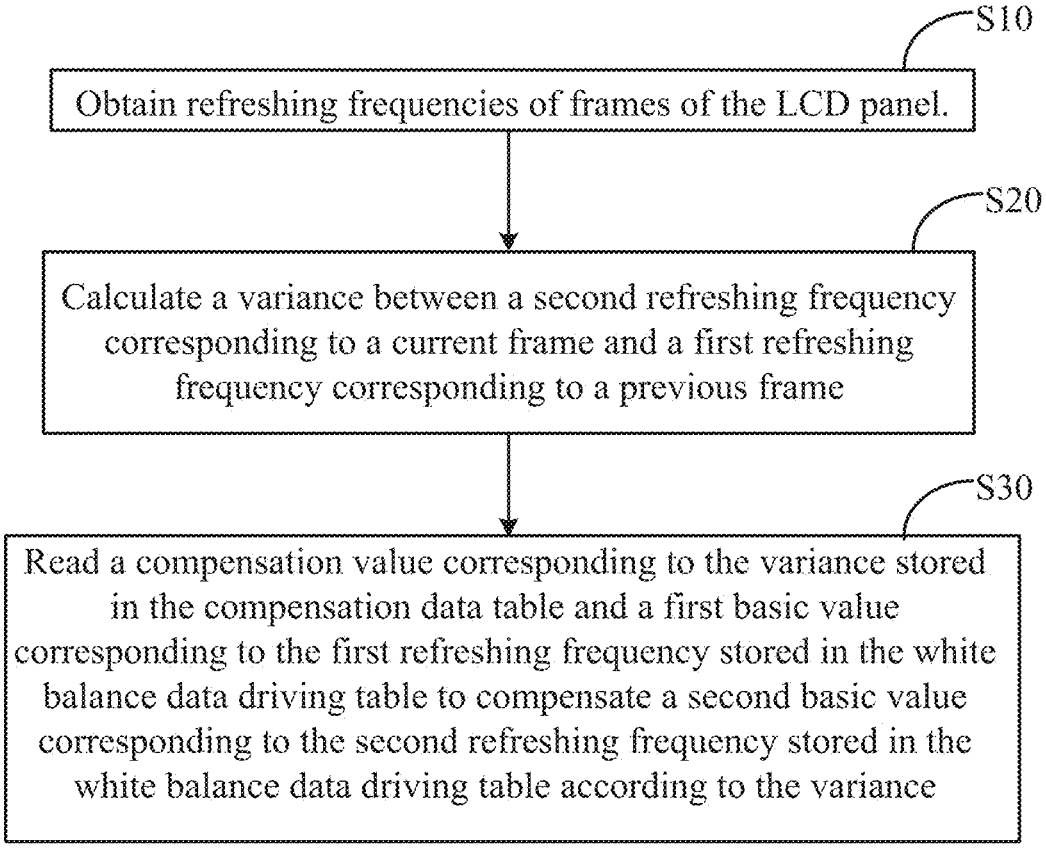
FIG. 3 is a flow chart of a grey voltage adjusting method of an LCD display according to an embodiment of the present invention.

As shown in FIG. 3, a method of adjusting grey voltages of an LCD display is disclosed. The method comprises following steps: Step S10: obtaining a refreshing frequency of a frame of the LCD panel. Step S20: calculating a variance between a second refreshing frequency corresponding to a current frame and a first refreshing frequency corresponding to a previous frame. Step S30: reading a compensation value corresponding to the variance stored in the compensation data table and a first basic value corresponding to the first refreshing frequency stored in the white balance data driving table to compensate a second basic value corresponding to the second refreshing frequency stored in the white balance data driving table according to the variance. In this embodiment, when the variance is not zero, the second basic value is a sum of the first basic value and the compensation value; and the first basic value and the second basic value are both configured to adjust a corresponding grey voltage.

Through reading the compensation value according to the variance between refreshing frequencies, the second basic value in the white balance data driving table could be compensated based on the first basic value accordingly. This could efficiently improve the grey voltage difference between after and before switching the refreshing frequency. This could efficiently improve the flicker issue.

In an embodiment, an LCD panel is disclosed. The LCD panel comprises the above-mentioned timing controller 100.

The LCD panel could utilize the timing controller 100 to read the compensation value according to the variance between refreshing frequencies and compensate the second basic value in the white balance data driving table based on the first basic value accordingly. This could efficiently improve the grey voltage difference between after and before switching the refreshing frequency. This could efficiently improve the flicker issue.

Above are embodiments of the present invention, which does not limit the scope of the present invention. Any modifications, equivalent replacements or improvements within the spirit and principles of the embodiment described above should be covered by the protected scope of the invention.

What is claimed is:

1. A timing controller, having a white balance data driving table, the timing controller comprising:

a detecting circuit, configured to detect and obtain a refreshing frequency according to a frame starting signal of the timing controller;

a control circuit, connected to an output end of the detecting circuit, configured to receive the refreshing frequency, buffer a first refreshing frequency corresponding to a previous frame, and output a control command corresponding to a variance between the first refreshing frequency and a second refreshing frequency corresponding to a current frame; and a compensation circuit comprising a register that stores a compensation data table, connected to an output end of the control circuit, configured to read a compensation value corresponding to the variance stored in the compensation data table and a first basic value corresponding to the first refreshing frequency stored in the white balance data driving table to compensate a second basic value corresponding to the second refreshing frequency stored in the white balance data driving table according to the control command;

wherein when the variance is zero, the control circuit stop outputting the control command; and when the variance is not zero, the second basic value is a sum of the first basic value and the compensation value.

2. The timing controller of claim 1, wherein the variance is a difference between the second refreshing frequency and the first refreshing frequency; a scale of the variance is corresponding to a scale of the compensation value; when the variance is more than zero, the compensation value is a negative value; and when the variance is less than zero, the compensation value is a positive value.

3. The timing controller of claim 1, wherein the variance is a difference between the second refreshing frequency and the first refreshing frequency; a scale of the variance is corresponding to a scale of the compensation value; when the variance is more than zero, the compensation value is a positive value; and when the variance is less than zero, the compensation value is a negative value.

4. The timing controller of claim 1, wherein when the variance is not zero, the compensation circuit writes a sum of the first basic value and the compensation value into an address corresponding to the second basic value in the write balance data driving table.

5. The timing controller of claim 1, further comprising a white balance processing unit storing the white balance data driving table.

6. The timing controller of claim 1, wherein the control circuit comprises a random access memory, configured to buffering the first refreshing frequency.

7. The timing controller of claim 1, wherein the white balance data driving table comprises a plurality of basic values, configured to adjust a corresponding grey voltage; and the first basic value and the second basic value are both the basic values.

8. A method for adjusting a grey voltage of a liquid crystal display (LCD) panel, comprising:

obtaining refreshing frequencies of frames of the LCD panel;

calculating a variance between a second refreshing frequency corresponding to a current frame and a first refreshing frequency corresponding to a previous frame; and reading a compensation value corresponding to the variance stored in a compensation data table and a first basic value corresponding to the first refreshing frequency stored in a white balance data driving table to compensate a second basic value corresponding to the second refreshing frequency stored in the white balance data driving table according to the variance;

wherein when the variance is not zero, the second basic value is a sum of the first basic value and the compensation value; and the first basic value and the second basic value are both configured to adjust a corresponding grey voltage.

9. The method of claim 8, wherein the variance is a difference between the second refreshing frequency and the first refreshing frequency; a scale of the variance is corresponding to a scale of the compensation value; when the variance is more than zero, the compensation value is a negative value; and when the variance is less than zero, the compensation value is a positive value.

10. The method of claim 8, wherein the variance is a difference between the second refreshing frequency and the first refreshing frequency; a scale of the variance is corresponding to a scale of the compensation value; when the variance is more than zero, the compensation value is a positive value; and when the variance is less than zero, the compensation value is a negative value.

11. The method of claim 8, wherein when the variance is not zero, writing a sum of the first basic value and the compensation value into an address corresponding to the second basic value in the write balance data driving table.

12. A liquid crystal display (LCD) panel, comprising a timing controller, the timing controller having a white balance data driving table, the timing controller comprising:

a detecting circuit, configured to detect and obtain a refreshing frequency according to a frame starting signal of the timing controller;

a control circuit, connected to an output end of the detecting circuit, configured to receive the refreshing frequency, buffer a first refreshing frequency corresponding to a previous frame, and output a control command corresponding to a variance between the first refreshing frequency and a second refreshing frequency corresponding to a current frame; and a compensation circuit comprising a register that stores a compensation data table, connected to an output end of the control circuit, configured to read a compensation value corresponding to the variance stored in the compensation data table and a first basic value corresponding to the first refreshing frequency stored in the white balance data driving table to compensate a second basic value corresponding to the second refreshing frequency stored in the white balance data driving table according to the control command;

wherein when the variance is zero, the control circuit stop outputting the control command; and when the variance is not zero, the second basic value is a sum of the first basic value and the compensation value.

13. The LCD of claim 12, wherein the white balance data driving table comprises a plurality of basic values configured to adjust a corresponding grey voltage.

14. The LCD of claim 13, wherein the variance is a difference between the second refreshing frequency and the first refreshing frequency; a scale of the variance is corresponding to a scale of the compensation value; when the variance is more than zero, the compensation value is a negative value; and when the variance is less than zero, the compensation value is a positive value.

15. The LCD of claim 13, wherein the variance is a difference between the second refreshing frequency and the first refreshing frequency; a scale of the variance is corresponding to a scale of the compensation value; when the variance is more than zero, the compensation value is a positive value; and when the variance is less than zero, the compensation value is a negative value.

16. The LCD of claim 13, wherein when the variance is not zero, the compensation circuit writes a sum of the first basic value and the compensation value into an address corresponding to the second basic value in the write balance data driving table.

17. The LCD of claim 13, wherein the timing controller further comprises a white balance processing unit storing the white balance data driving table.

18. The LCD of claim 13, wherein the control circuit comprises a random access memory, configured to buffering the first refreshing frequency.

* * * * *